US006098979A

United States Patent [19]

Rogers

[11] Patent Number: 6,098,979

[45] Date of Patent: Aug. 8, 2000

[54] DARKHORSE WAGERING: A LOTTERY METHOD OF PLAY

[76] Inventor: Daniel Edwin Rogers, 146 Highvue Dr., Venetia, Pa. 15367

[21] Appl. No.: 09/144,594

[22] Filed: Aug. 31, 1998

[51] Int. Cl.[7] ..... A63B 71/00; A63F 1/00

[52] U.S. Cl. ..... 273/138.1; 463/16; 273/139

[58] Field of Search ..... 273/138.1, 139, 273/269; 463/17, 18, 42

[56] References Cited

U.S. PATENT DOCUMENTS

| | | | |
|---|---|---|---|
| 5,317,135 | 5/1994 | Finocchio | 463/17 |
| 5,417,424 | 5/1995 | Snowden et al. | 463/18 |
| 5,536,016 | 7/1996 | Thompson | 273/269 |
| 5,580,311 | 12/1996 | Haste et al. | 463/17 |
| 5,772,510 | 6/1998 | Roberts | 463/17 |
| 5,772,511 | 6/1998 | Smeltzer | 463/17 |
| 5,791,990 | 8/1998 | Schroeder et al. | 463/17 |
| 5,944,606 | 8/1999 | Gerow | 463/27 |
| 5,954,582 | 9/1999 | Zach | 463/25 |

*Primary Examiner*—Jeanette Chapman
*Assistant Examiner*—M. Chambers

[57] ABSTRACT

The invention is the "Darkhorse" method of selecting the winning number in a multiple number selection lottery contest, (a so-called "numbers game"). Instead of randomly selecting the winning number at the close of play by use of a random number generating device, the winning number is declared to be, by rule of the game, that number upon which the least amount of money will be wagered during the course of the game. In case of a tie, the lowest number played least is declared to be the winning number. As the game proceeds, numbers, as they are played, are entered into the memory of a digital computer programmed to sort the numbers, tally the amounts wagered on each number, and feed back to the lottery wager-entry terminals the identity of the lowest number played least and such other information as the contest operator may choose to disclose to wagerers as the game progresses. (The contest operator may choose to conduct the game "blind," that is without any feedback of any information to the wagerers during the course of the game.) At the close of play the contest operator immediately discloses the lowest number played least during the contest. Using this winning number selection method a lottery operator will never have to pay out in winnings any more money than the operator took in as wagers.

As a variation of this method of number selection, wagerers may be offered the option of "unplaying" a number, thus reducing that number's score in the game and enhancing that number's chance of being the winning number. Each "unplay" of a number costs the "unplayer" an amount of money established by rule of the game, at least equal to the amount of a positive wager placed on that number, but it does not give the "unplayer" an additional chance at winning. Using the "unplay" option enhances interest in the contest by making it more interactive, but it also exposes the lottery operator to the possibility that it will have to pay out in winnings an amount of money in excess of the amount taken in as wagers.

8 Claims, No Drawings

DARKHORSE WAGERING: A LOTTERY METHOD OF PLAY

SUMMARY OF THE INVENTION

As a new method of selecting the winning number in any standard numbers game, such as the three digit "daily number" game operated by many States, the winning number can be declared by game rule to be the lowest number played least during the course of the game. The players themselves thus select the winning number, the number they play the least, the "darkhorse" in the contest. A computer keeps track of the numbers as they are played and can feed back to the wagerers, on an instantaneous or delayed basis, information regarding total wagering to any point in the game. Use of this number selection method enables lottery operators to offer higher payouts without risk of having to pay out more in winnings than they take in as wagers. As a variation of this winning number selection method, wagerers can be given the option of "unplaying" numbers, thus driving down such numbers' scores and enhancing the chance of each such number to be the winning number.

SPECIFICATION

Method of Number Selection.

As numbers are played by wagerers during the course of a "numbers" game such as a "daily number" lottery operated by a State, the numbers played are recorded and sorted by a digital computer using any one of a number of numerical sort programs commercially available so that at the end of the game the computer has a complete record of how much money was wagered on each of the numbers. The winning number would be the number upon which the least amount of money was wagered during the game (hereinafter referred to as "the number played least"). The amount of money wagered on a number during the game would be its "score" for the game, and the number with the lowest score would be the winning number. (Such determination of the winning number as the number least favored by wagerers is referred to by the inventor as "Darkhorse" wagering and is so designated hereinafter.) In the event that two or more numbers are determined to have had the least amount of money wagered on each of them, then the lowest number played least is the winning number.

By designating as the winning number the lowest number played least, the operator of the lottery will be able to offer a substantially higher payoff rate to winning wagerers than is now feasible in numbers lottery games where the winning numbers are selected by mechanical or electronic random number selection devices. Utilizing this Darkhorse number selection method, a lottery operator can offer a high payoff or even a full payoff—e.g. a one thousand to one payoff in a one thousand number game—without running the risk of having to pay out in winnings an amount of money in excess of the amount taken in as wagers.

Having the ability to offer a much higher payoff than is feasible for other lottery operators using any other methods of number selection, the lottery operator using this "Darkhorse" number selection method will be able to compete successfully with such other lottery operators even to the point of rendering the competing operations unprofitable and driving such operations out of business. If the Darkhorse lottery is a government-operated or government-sanctioned enterprise, and the competing lottery is an illegal operation, the legal lottery could thus be used to drive the illegal operation out of business. Although an illegal lottery operator might also adopt the Darkhorse method of selecting winning numbers, certain refinements of the Darkhorse number selection method could be adopted by the legal operation that would not be feasible for an illegal operation. Such refinements are:

Feedback to Wagerers.

Minute by minute, as wagers are placed and recorded, the central lottery computer recording the numbers as they are played can automatically transmit to the terminals upon which the wagers are entered the number which is the lowest number played least to that point ("leading number feedback"), or any other information regarding the game in progress that the operator might wish to transmit to the wagering public. Such information can be, but need not be, disclosed to the wagering public through electronic readout display panels located at the terminal locations. Such feedback of information to the wagerers while the game is in progress should enhance interest in the game and encourage the placement of additional wagers. Such feedback of information to the wagering public would not be feasible for an illegal lottery operation in view of the risk of detection and apprehension by law enforcement authorities.

The display of leading number feedback will tend to reduce substantially the amount of money that the lottery operator will take in as profit in any given game, since keeping the wagerers currently informed of the lowest number played least will tend to encourage additional wagers on that particular number, whatever it may be from time to time during the course of the game. At the end of the game, if logic generally prevails among the wagerers, there will be no number that has been played far less often than any other number. Wagerers will tend to flock to any sparsely played numbers, especially in the closing moments of the game, driving up the ultimate number of players of the winning number.

The "Unplay" Option.

To counteract this tendency in a Darkhorse game played with feedback, while preserving the allure of information feedback to the wagerers, players can be given the option to "unplay" one or more numbers during the game, paying for each such "unplay" an amount of money equal to the amount of an ordinary wager. Each such "unplay" will be counted to reduce, rather than increase, the number of times a particular number's plays will be counted in determining the eventual winning number. No additional chances at winning are awarded for such "unplays." The money paid for unplays will thus enure to the game operator's profit margin. There is, however, a significant risk involved in the use of the "unplay" option.

Having the "unplay" option available without limit exposes the game operator to the possibility of massive losses to a wagerer having sufficient money to both play and "unplay" one number a great many times in a single game. If a one thousand number game ordinarily would draw, for example, $2,000,000 in wagers per day, a person with $10,000,000 available to him could play one number four million times and simultaneously "unplay" that same number six million times. If that should occur, the number selected for play and "unplay" by the wealthy wagerer would almost certainly end up the game as the lowest number played least. Indeed it is likely that that number's "score" for the game would end up in negative numbers. Having taken in Twelve Million Dollars from the wagering public in that one game, the game operator would owe Four Billion Dollars to the wealthy wagerer to cover the Four Million Dollars in wagers placed by him. This risk can be offset or eliminated: (1) by a game rule allowing an "unplay" purchase to be made only in conjunction with a simultaneous play of the same number; (2) by a game rule entirely eliminating from contention any number that ends up the game with more "unplays" than plays—i.e. in negative territory; (3) by a game rule allowing the game operator himself to "unplay" any number an unlimited number of times during the game, thus enabling the game operator to drive down any other number in the game to a level lower than the number posing the risk of a major payout; (4) by a game rule prohibiting the purchase of "unplays" during the final hour of the game.

BEST MODE OF CARRYING OUT THE INVENTION

The best modes contemplated by the inventor of carrying out this invention are:

(A) as the method for selecting the winning number or numbers in a State lottery game, with payment for winning wagers made in strict conformity with the odds of selecting the winning number or numbers, as a means of countering illegal lotteries operating in the State and raising revenues for the State;

(B) as the method for selecting the winning number or numbers in a national lottery game for the financial support of government projects that are controversial as recipients of tax revenues, such as the National Endowment for the Arts, space exploration, expansion of national parks and recreation areas, national health care programs, family planning programs, public welfare programs, and the like;

(C) as the method for selecting the winning number or numbers in on-air fund-raising lotteries operated by public television stations;

(D) as the method for selecting the winning number or numbers in gambling casino "parlor" games similar to bingo or keno; and (E) as the method for selecting the winning number or numbers in fund-raising lotteries operated world-wide on the internet for the purpose of preserving habitats for endangered or threatened species of animals and plants.

What is claimed is:

1. A method for conducting lotteries, including the following steps:

(a) selecting a series of indicia on a game ticket by a player;

(b) presenting the game ticket for entry into a lottery game;

(c) entering of data information on the game ticket into a computer;

(d) transmitting said data information to a central computer;

(e) generating a game ticket imprinted with the selected indicia for use in playing the game;

(f) ranking by the computer of all numbers played in a game by a total amount bet on each number;

(g) generating a winning number by;

1) not taking any new bets once a game has ended;

2) calculating a total amount bet for each number bet in said game, and;

3) ranking said total amount bet numbers in a descending order from a highest amount bet to a lowest amount bet; said winning number having a lowest corresponding total amount bet greater than zero; and (h) paying a winning player a winning earnings.

2. The method of claim 1 wherein the indicia selected is provided by the player.

3. The method of claim 1 wherein the indicia selected is provided by a computer-generated random number selection.

4. The method of claim 1 wherein all games tickets presented for playing are disposed of.

5. The method of claim 1 wherein the player can "unplay" a previous selection of numbers.

6. The method of claim 1 wherein feedback on the numbers selected during a course of the game is displayed to said player.

7. The method of claim 1 wherein the game ticket can be printed indicia.

8. The method of claim 1 wherein the game ticket can be displayed electronically.

* * * * *